United States Patent [19]

Gibson et al.

[11] 4,241,231

[45] Dec. 23, 1980

[54] ISOMERIZATION PROCESS FOR UPGRADING LOW-OCTANE LIGHT PARAFFINIC FEEDS USING A CHLORIDED PLATINUM-ALUMINA-RHENIUM CATALYST

[75] Inventors: Kirk R. Gibson, El Cerrito; Robert L. Jacobson, Hercules; Manfred J. Michlmayr, Orinda, all of Calif.

[73] Assignee: Chevron Research Company, San Francisco, Calif.

[21] Appl. No.: 947,792

[22] Filed: Oct. 2, 1978

[51] Int. Cl.[2] ..... C07C 5/28

[52] U.S. Cl. ..... 585/748; 208/139; 585/747

[58] Field of Search ..... 208/139; 260/683.68; 585/747, 748

[56] References Cited

U.S. PATENT DOCUMENTS

| | | | |
|---|---|---|---|
| 3,078,323 | 2/1963 | Kline et al. | 260/683.65 |
| 3,131,235 | 4/1964 | Asselin | 260/683.68 |
| 3,558,479 | 1/1971 | Jacobson et al. | 208/139 |
| 3,573,199 | 3/1971 | McCoy | 208/139 |
| 3,617,522 | 11/1971 | Schrepfer | 208/139 |
| 3,679,602 | 7/1972 | Pollitzer | 252/442 |
| 3,718,710 | 2/1973 | Quisenberry | 260/683.67 |
| 3,816,300 | 6/1974 | Gallagher et al. | 208/139 |
| 3,848,019 | 11/1974 | Myers | 260/683.68 |
| 3,879,484 | 4/1975 | Pollitzer | 260/668 A |
| 3,974,061 | 8/1976 | Quisenberry | 208/65 |

*Primary Examiner*—C. Davis

*Attorney, Agent, or Firm*—D. A. Newell; R. H. Davies; W. L. Stumpf

[57] ABSTRACT

Isomerizable light paraffinic hydrocarbon feeds are isomerized in an improved process using a particular super-chlorided reforming catalyst under isomerizing conditions. A chloride source in the feed stabilizes the catalyst. This process provides for a material octane improvement of the feed without excessive loss thereof to normally gaseous hydrocarbons.

10 Claims, 2 Drawing Figures

ISOMERIZATION PROCESS FOR UPGRADING LOW-OCTANE LIGHT PARAFFINIC FEEDS USING A CHLORIDED PLATINUM-ALUMINA-RHENIUM CATALYST

BACKGROUND OF THE INVENTION

The present invention relates to an improved catalytic process for isomerizing light paraffinic hydrocarbon feeds containing, calculated as sulfur, less than about 5 ppmw of sulfur-containing impurities.

It is well known in the art that in the typical production of motor fuel from crude oil in a refinery, a material portion of the product is a light paraffinic fraction (LPF). For example, in a refinery processing 50,000 barrels per day of crude oil, as much as 9000 barrels per day of LPF product may be produced. Typically, LPF product, although deficient in terms of octane-number quality, is added to the refinery gasoline pool. The octane number deficiency of the LPF component is usually made up by adding an octane improver to the pool, for example tetramethyl lead and/or a sufficient quantity of high-octane component, e.g., reformate. However, in the near future, in order to reduce environmental pollution, the amount of lead-containing compounds which may be added to gasoline will be severely limited by law. Consequently, there is a need for an effective process for upgrading LPF-type hydrocarbon mixtures. Normally, costly hydrogen gas is required for the isomerization reaction; our process, in contrast, provides for the in-situ generation of hydrogen gas. However, hydrogen generation by conventional reforming is normally effected under such severe conditions that excessive cracking of a portion of the feed to lighter hydrocarbon gases occurs. Accordingly, there is a need for generation of hydrogen gas in an isomerization process where loss of liquid feed to light gas production is minimal.

A two-stage process for catalytic reforming of a hydrocarbon charge containing less than 51 volume percent of cyclics is taught in U.S. Pat. No. 3,617,522. In the first stage, reforming of the charge is continued until the catalyst becomes relatively inactive. In the second stage, activity of the catalyst is restored and/or promoted by including water in the feed.

A process for isomerizing hydrocarbon feeds using a halided platinum-aluminum-rhenium catalyst is disclosed in U.S. Pat. Nos. 3,679,602 and 3,879,484.

A process for hydrotreating and isomerizing at relatively moderate temperatures $C_5$ and $C_6$ hydrocarbon streams is disclosed in U.S. Pat. No. 3,718,710.

A process for increasing yields in converting hydrocarbons by contact thereof with a platinum-alumina-rhenium catalyst in the presence of water vapor is taught in U.S. Pat. No. 3,816,300.

A method for maintaining the activity of a rhenium-containing catalyst at a high level is taught in U.S. Pat. No. 3,848,019 for use in isomerizing a hydrocarbon stream at temperatures in the range 100° F. to 600° F. In the method, a small amount of a halogen-containing compound is included in the feed.

SUMMARY OF THE INVENTION

It is an object of this invention to provide a process for increasing the octane number of a light paraffinic hydrocarbon feed containing, calculated as sulfur, less than about 5 ppmw of sulfur-containing impurities, which comprises:

(I) contacting in a reaction zone a porous alumina-based catalytic composite with a mixture of said feed, hydrogen gas and at least one chloride source selected from the group consisting of hydrogen chloride, chlorine gas, phosgene and chlorinated hydrocarbons which liberate hydrogen chloride at said contacting, said contacting being under isomerizing conditions, including (1) a temperature in the range of from about 350° to 420° C., preferably 365° to 390° C., (2) a hydrogen partial pressure in the range of from about 25 to 500 psia, (3) a liquid hourly space velocity, V/V/Hr, in the range of from about 0.5 to 5, (4) a hydrogen-to-feed mol ratio in the range of from about 2 to 10, and (5) a feed-to-chloride mol ratio in the range of from about $1.0\times10^3$ to $1.0\times10^5$; said composite, based by weight upon alumina and calculated as the element, containing an amount of chloride in the range of from about 1 to 3.0 weight percent, and an amount each of platinum and rhenium in the range of from about 0.1 to 1 weight percent;

(II) separating the mixture resulting from step (1) in a liquid-gas separation zone into (1) a gaseous fraction comprising mainly hydrogen gas, hydrogen chloride and a minor amount of normally gaseous hydrocarbons, and (2) a first liquid hydrocarbon fraction;

(III) withdrawing said gaseous fraction from said separation zone and passing at least a portion thereof in recycle to said reaction zone;

(IV) fractionally distilling said separated first liquid fraction into a second liquid fraction and a normally gaseous hydrocarbon fraction, said second liquid fraction, relative to said feed, having an improved octane number.

Figure 1:
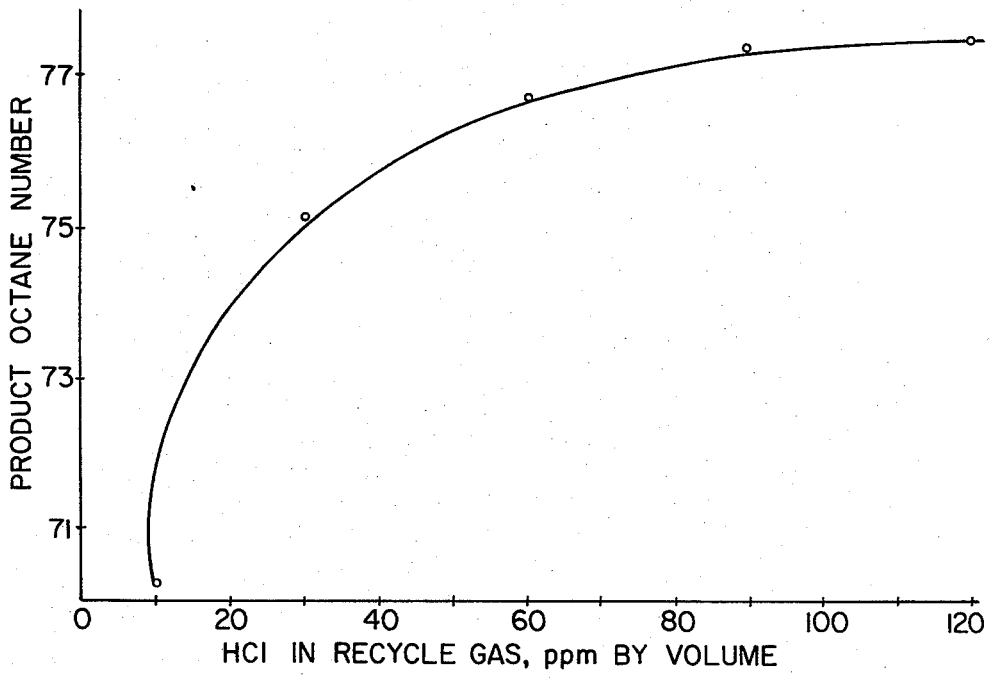
FIG. 1 shows the relationship of the product octane number to the quantity of hydrogen chloride in the recycle gas. The relationship of the relative yield-octane advantage to the process temperature is shown in FIG. 2.

In a more specific embodiment, this invention relates to the aforedescribed isomerization process wherein a gaseous recycle stream having a hydrogen chloride content in the range of from about 10 to 250, preferably 30 to 100, ppm by volume is included in the feed to the reaction zone.

Other objects and embodiments will be found in the following further detailed description of this invention.

By the expression "isomerizable" as used herein in connection with a hydrocarbon feed is meant that the ratio of the i-$C_5$ to n-$C_5$ concentrations and/or of the i-$C_6$ to n-$C_6$ concentrations of the feed is less than the corresponding ratio of equilibrium mixtures of these feeds at the contact temperature of the process.

By the expression "light paraffinic hydrocarbon" as used herein in connection with a process feed is meant by definition $C_5$–$C_6$ hydrocarbon mixtures normally obtained by distilling crude oil at or near atmospheric pressure, and the like refinery hydrocarbon mixtures (normally containing a minor amount of $C_7$ hydrocarbons as well).

EMBODIMENT

In a preferred embodiment, a light straight-run $C_5$–$C_6$ refinery cut is mildly hydrotreated to a sulfur-content level below 5 ppmw and used as the process feed, for example using an ordinary alumina-supported cobalt-molybdenum catalyst under conditions including:

| | |
|---|---|
| Temperature, °C. | 290–400 |
| LHSV, V/V/Hr | 3 |
| Hydrogen Partial Pressure, Atm. | 10 |

Two typical hydrotreated light paraffinic hydrocarbon feeds have the following compositions:

| Feed Breakdown, LV % | A | B |
|---|---|---|
| Paraffins | | |
| $C_5$ | 20.0 | 27.1 |
| $C_6$ | 69.5 | 47.0 |
| $C_7$ | 1.0 | 8.1 |
| Cyclics | 9.5 | 14.0 |
| Distribution of $C_5$ Paraffins | | |
| i-$C_5$ | 14.6 | 34.4 |
| n-$C_5$ | 85.4 | 65.6 |
| Distribution of $C_6$ Paraffins | | |
| 2,2-Dimethylbutane | 0.5 | 1.1 |
| 2,3-Dimethylbutane | 4.0 | 4.7 |
| 2-Methylpentane | 25.4 | 29.2 |
| 3-Methylpentane | 19.9 | 18.9 |
| n-Hexane | 50.2 | 46.1 |
| Research Octane No., Clear | 59.6 | 64.7 |

These feeds are isomerized in a fixed-bed reactor by contact thereof with a chlorided platinum-alumina-rhenium (CPAR) catalyst containing about 0.3 weight percent each of platinum and rhenium and about 1.0 weight percent of chloride (see, for example, U.S. Pat. No. 4,082,697 [−697], which is hereby referred to and incorporated herein by reference). This catalyst, prior to use, is super-chlorided (see discussion below) to a chloride content of about 2 weight percent.

The conditions for the contacting include:

| | |
|---|---|
| Temperature, °C. | 365–390 |
| $H_2$-to-Feed Mol Ratio | 2–10 |
| Feed-to-Chloride Mol Ratio | $1.5 \times 10^4$ |

Concurrently, hydrogen gas is generated, the resulting reaction mixture is withdrawn from the reactor and passed to a liquid-gas separator wherein the mixture is separated into a gas fraction comprising hydrogen gas containing a minor amount (about 60 ppmw) of hydrogen chloride. This fraction, less a bleed stream as required to maintain the desired hydrogen gas-to-feed ratio in the reactor, is recycled to the reactor. The hydrogen chloride level in the recycle gas is maintained by introducing fresh hydrogen chloride or a suitable chloride source, for example a butyl chloride, into the reactor. This introduction may be made into the feed stream, the recycle stream or directly, as convenient. So long as the recycle stream contains about 60 ppmw of hydrogen chloride, the required feed-to-chloride mol ratio in the reaction zone is, in general, maintained and excellent ratios of iso-to-normal concentrations of the $C_5$ and $C_6$ components of the resulting product are achieved.

The separated liquid fraction in the liquid-gas separator is withdrawn and passed to a fractional distillation unit where it is separated into a normally gaseous overhead light hydrocarbon fraction and a bottoms product fraction which, relative to the feed, has an improved octane number. Typical product mixtures for the above feeds have the following $C_5$ and $C_6$ compositions:

| Product Breakdown, LV % | | A | B |
|---|---|---|---|
| Total $C_5$ Paraffins | | | |
| i-$C_5$ | | 63.1 | 60.1 |
| n-$C_5$ | | 36.9 | 39.9 |
| Total $C_6$ Paraffins | | | |
| 2,2-Dimethylbutane | | 12.6 | 11.7 |
| 2,3-Dimethylbutane | | 8.0 | 7.9 |
| 2-Methylpentane | | 32.6 | 32.8 |
| 3-Methylpentane | | 23.0 | 23.2 |
| n-Hexane | | 23.8 | 24.4 |
| Research Octane No., Clear | approx. | 74 | 74.8 |

In these runs, the yield loss to cracking is about 3 liquid volume percent in the form of a $C_4$-normally gaseous hydrocarbon mixture.

In a further preferred embodiment, the isomerization herein is carried out without a net make or consumption of hydrogen gas. Operation of the process in this mode provides a number of advantages, including (1) costly hydrogen gas is not required for the process, (2) means for recovery and/or use of moderate amounts of impure hydrogen gas are not required, and (3) a hydrogen gas partial pressure level favorable for modest, if any, concurrent hydrocracking and appreciable aromatizing of aromatizable feed components is automatically achieved after a short time on stream. This level is reached by operating under a generated hydrogen partial pressure wherein no fresh (outside) hydrogen gas is introduced to the process. The generated hydrogen partial pressure mode is conveniently achieved by initiating the process using a suitable hydrogen-to-feed mol ratio (for example in the range described above) and, while for practical purposes, recycling all of the hydrogen gas present in the product stream, the introduction of fresh (outside or non-recycle) hydrogen to the feed is stopped. With continuing operation in this manner, the hydrogen partial pressure in the process automatically levels out. The generated hydrogen partial pressure varies, depending upon the particular feed being fed to the process. Further advantages of operating in the generated hydrogen gas partial pressure mode include (1) a substantial reduction in the hydrogen chloride makeup required to maintain a satisfactory hydrogen chloride to feed ratio or inventory in the process, and (2) surprisingly, the generated hydrogen partial pressure mode conditions are reasonably proximate to the optimum conditions, in terms of low light gas make and realization of the octane improvement potential for the feed. By definition, by the term "generated hydrogen partial pressure" as used herein is meant hydrogen partial pressure resulting from operating the process without adding to the process hydrogen gas from an outside source, that is, without a net make or consumption of hydrogen gas.

Chloride Level

For effective isomerization of unbranched and slightly branched paraffins to more highly branched paraffins without excessive cracking of a portion of the feed to normally gaseous hydrocarbons, it is essential that the reaction be carried out in the presence of an appreciable amount of hydrogen chloride. The hydrogen chloride effect is demonstrated in FIG. 1, which represents data collected on a run isomerizing Feed A described above. This run was continued for a period of at least 294 hours at a temperature of 371° C., a total pressure of 20.4 atmospheres gauge, a hydrogen-to-feed mol ratio of 6.0 and a liquid hourly space velocity of 1.0.

The catalyst employed in this run was a modified alumina-supported reforming catalyst containing about 0.3 weight percent each of platinum and rhenium and about 1.0 weight percent of chloride. This catalyst was super-chlorided by contact thereof with t-butyl chloride which was included in the feed. The chloride content of the resulting catalyst is estimated as being about 2 weight percent. The hydrogen chloride content of the hydrogen chloride-containing recycle gas (see description above of preferred embodiment) was determined by ordinary means. From FIG. 1, it is clear that for effective (optimum isoalkane content) isomerization, the reaction mixture in the reaction zone must have an appreciable content of hydrogen chloride. This content must, in general, be sufficient to maintain the catalyst in a "super-chlorided" state (see discussion below). In terms of the recycle gas stream, this content should be at least about 10, preferably 60 ppmv. Good results are achieved when the recycle gas contains an amount of hydrogen chloride in the range of from about 40 to 150 ppmv. In terms of the feed-to-chloride (hydrogen chloride) mol ratio in the reaction the ratio must be in the range of from about $1.0\times10^3$ to $1.0\times10^5$.

The required hydrogen chloride may be supplied either directly or indirectly to the reaction zone by any suitable means whether separately, in admixture with a hydrogen gas recycle stream, in admixture with the hydrocarbon feed, or a combination thereof. It may be supplied indirectly by introducing a precursor which forms hydrogen chloride as a dissociation and/or reaction product under the contact conditions of the present invention. Representative precursors include chlorine gas, phosgene, organic acid chlorides and chlorinated hydrocarbons, such as butyl chloride, carbon tetrachloride and the like. Chlorinated hydrocarbons are preferred.

Two chloride levels can be involved in the present process. The first, which is described above, relates to the hydrogen chloride in the reactant mixture which is contacted with the catalyst. The second chloride level relates to chloride contained by the catalyst, part of which is believed to be relatively strongly bound, and a remainder which is relatively loosely bound and more or less transient, as shown, for example, by a reduction of the chloride content of the catalyst and of the iso-to-normal ratio of the product when hydrogen chloride is omitted from the recycle gas or reaction zone. For satisfactory isomerization rates, the CPAR catalyst employed herein must have a high chloride content, for example a chloride content in the range of from about 1 to 3 and higher weight percent, preferably about 1.5 to 2.5%. The transient chloride, at least in part, is believed to be responsible for the isomerization activity of a CPAR catalyst. In the absence of an appreciable partial pressure of hydrogen chloride in the reactant mixture, transient chloride and isomerization activity is lost from a CPAR catalyst, especially at the elevated temperatures required herein. This loss appears to be enhanced when the feed contains water, and relatively higher feed-to-chloride must be employed with feeds containing water. High chloride contents for CPAR-type catalysts are generally thought to be cnsistent with high acidity and high cracking activity. In the present process, which is carried out under rather elevated temperatures in the presence of hydrogen chloride, there is little loss of feed through cracking. That is, indeed, a surprising result.

The use of a chlorided platinum-alumina-rhenium catalyst composite is essential to achieving a satisfactory process herein. The basic catalyst and its method of manufacture for use in reforming service are well known in the art, as may be noted from the U.S. Patents cited above. For present purposes, a higher chloride level than the 1 weight percent level oridnarily used in reforming is desirable, for example a chloride content of the order of 1.5–2.5, preferably about 2, weight percent, that is, a super-chlorided CPAR catalyst. A super-chlorided catalyst is conveniently obtained by contacting a cnventional reforming catalyst with a suitable chloride source (see discussion above) and then maintaining this level by operating at a satisfactory feed-to-hydrogen chloride level in the reaction zone.

The alumina carrier or support must be porous and have an appreciable surface area and pore volume. Desirably at least a major portion of the pore volume is supplied by pores having diameters in the 80- to 200-Angstrom range. Any porous alumina conventionally used as a support for a noble metal catalyst is satisfactory for use herein, although best results are believed to be obtained when the carrier is gamma-alumina. Representative surface areas are in the range of from about 25 to 500 $m^2$ per gram and higher. Representative pore volumes are in the range of from about 0.3 to 0.8 cc/cc. Carriers and catalysts prepared by the process of the -697 patent cited above, after super-chloriding, are preferred for use herein.

The light paraffinic hydrocarbon feeds required for the process of the invention vary depending upon the crude oil source and the sharpness of the distillation cut. In general, at least 80 volume percent of the feed is composed of $C_5$ and $C_6$ hydrocarbons, the balance comprising $C_4$ and $C_7$ hydrocarbons. Of the $C_5$ and $C_6$ fraction, the major portion is composed of unbranched and slightly branched alkanes and a minor fraction (based upon total feed, 1–20 volume percent) is composed of cyclic hydrocarbons, including methylcyclopentane, cyclopentane, cyclohexane and benzene. For good results, the feed will contain an appreciable (in the 0.5 to 10 volume percent range) content of $C_7$+ alkanes. These and any naphthenes, if present, provide a source of in situ-generated hydrogen gas, making the process, in a desirable optimum, self-sufficient in connection with the hydrogen gas requirement. Representative process feeds, in addition to feeds A and B described above, have the following compositions:

| | |
|---|---|
| Gravity, °API | 50–75 |
| Sulfur, ppmw | 1–5 |
| Component Analysis, Wt. % | |
| $C_4$-Alkanes | 5–6 |
| $C_5$-Alkanes | 30–37 |
| Isopentane | 15–18 |
| n-Pentane | 18–20 |
| Cyclopentane | 1–2 |
| Methylcyclopentane | 5–6 |
| $C_6$-Alkanes | 43–44 |
| 2,2-Dimethylbutane | 1–2 |
| 2,3-Dimethylbutane | 1–3 |
| 2-Methylpentane | 13–15 |
| 3-Methylpentane | 7–8 |
| n-Hexane | 16–20 |
| Cyclohexane | 2–3 |
| Benzene | 3–4 |

-continued

| | |
|---|---|
| $C_7$+-Alkanes | 2-7 |

Depending upon the particular light paraffinic feed employed, research octane improvements achieved from this process vary, and, in general, the improvement will be in the range of from about 5 to 30 octane numbers, usually 10 to 15, with only a minor (less than about 5 liquid volume percent) loss of the feed to normally gaseous hydrocarbons. Representative feeds suitable for use herein include light straight-run $C_5$–$C_6$ fractions, provided that the feed has a sulfur content below about 5, preferably 1, parts per million (by weight). Where the light paraffinic feed has an excessive content of sulfur-containing impurities, the excess can be readily removed by a conventional mild (see discussion above) hydrodesulfurization treatment or by sulfur sorption.

Desirably, but not necessarily so, the feed should contain little or no water. Water vapor appears to promote loss of chloride from the catalyst. In combination with the required hydrogen chloride in the reactant mixture, a substantial presence of water vapor in the process system is a source of corrosion problems in the reactor and process lines. In general, the feed should contain less than 20 ppmw, preferably less than 5 ppmw, of water vapor.

In addition to being essentially free of sulfur-containing impurities, the feed should contain little or no nitrogen-containing impurities. The latter tend to reversibly titrate catalyst sites and to form hydrochloride salts which may foul up the reactor and process lines. In general, the feed should contain (calculated as nitrogen) less than 10 ppmw, preferably less than 1 ppmw, of nitrogen-containing impurities.

The reaction temperature employed in the present process must be in the range of from about 350° to 420° C., preferably 365° to 390° C. At these temperatures, the super-chlorided CPAR catalyst required herein promotes, in the presence of hydrogen chloride, excellent and selective isomerization of the low-octane $C_5$–$C_6$ components of the feed without excessive hydrocracking of the feed to normally gaseous hydrocarbons. At the same time, the temperature is sufficient to provide for concurrent reforming of reformable components in the feed, such as methylcyclopentane, cyclohexane and $C_7$+ alkanes and cycloalkanes, with resultant production of hydrogen gas for use as a recycle and hydrogen gas source in the process.

EXAMPLE

Figure 2:
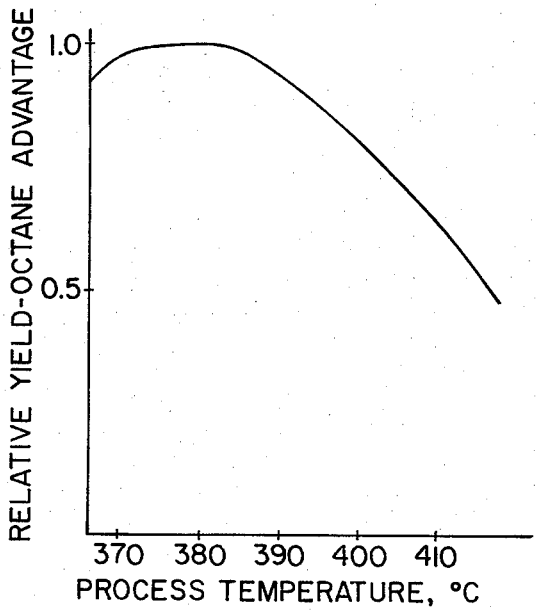

Comparative yield-octane data as a function of process temperature were obtained. Process conditions included using (1) an Arabian pentane-hexane fraction as the feed, (2) a pressure of 5.4 atmospheres gauge, (3) a space velocity, V/V/Hr, of 1.0, (4) a hydrogen gas-to-hydrocarbon mol ratio of 6.0, and (5) a content of hydrogen chloride in the recycle gas of 60 ppmw. The results are shown in FIG. 2. These data demonstrate excellent results when the process temperature is in the range of 365° to 390° C.

What is claimed is:

1. A process for increasing the octane number of an isomerizable light paraffinic hydrocarbon feed containing, calculated as sulfur, less than about 5 ppmw of sulfur-containing impurities, which comprises:

(I) contacting in a reaction zone a porous alumina-based catalytic composite with a mixture of said feed, hydrogen gas and at least one chloride source selected from the group consisting of hydrogen chloride, chlorine gas, phosgene and chlorinated hydrocarbons which liberate hydrogen chloride at said contacting, said contacting being under isomerizing conditions, including (1) a temperature in the range of from about 350° to 420° C., (2) a hydrogen partial pressure in the range of from about 25 to 500 psia, (3) a liquid hourly space velocity, V/V/Hr, in the range of from about 0.5 to 5, (4) a hydrogen-to-feed mol ratio in the range of from about 2 to 10, and (5) a feed-to-chloride mol ratio in the range of from about $1.0\times10^3$ to $1.0\times10^5$; said composite, based by weight upon alumina and calculated as the element, containing an amount of chloride in the range of from about 1 to 3.0 weight percent, and an amount each of platinum and rhenium in the range of from about 0.1 to 1 weight percent;

(II) separating the mixture resulting from step (1) in a liquid-gas separation zone into (1) a gaseous fraction comprising mainly hydrogen gas, hydrogen chloride and a minor amount of normally gaseous hydrocarbons, and (2) a first liquid hydrocarbon fraction;

(III) withdrawing said gaseous fraction from said separation zone and passing at least a portion thereof in recycle to said reaction zone;

(IV) fractionally distilling said separated first liquid fraction into a second liquid fraction and a normally gaseous hydrocarbon fraction, said second liquid fraction, relative to said feed, having an improved octane number.

2. A process as in claim 1 wherein said temperature is in the range of from about 365° to 390° C.

3. A process as in claim 1 wherein said chlorinated hydrocarbon is a butyl chloride.

4. A process as in claim 1 wherein said feed is a light straight-run naphtha.

5. A process for increasing the octane number of a light paraffinic hydrocarbon feed containing, calculated as sulfur, less than about 5 ppmw of sulfur-containing impurities, which comprises:

(I) contacting in a reaction zone a mixture of said feed, and a gaseous recycle stream with a porous alumina-based catalytic composite under isomerizing conditions, including (1) a temperature in the range of from about 350° to 420° C., (2) hydrogen partial pressure in the range of from about 25 to 300 psia, (3) a liquid hourly space velocity, V/V/Hr, in the range of from about 0.5 to 5, (4) a hydrogen-to-feed mol ratio in the range of from about 2 to 10, and (5) a feed-to-chloride mol ratio in the range of from about $1.0\times10^3$ to $1.0\times10^5$; said recycle stream having a hydrogen chloride content in the range of from about 10 to 250 ppm by volume, said chloride content of said recycle stream being maintained by continuously or intermittently introducing into said reaction zone a minor amount of at least one fresh chloride source selected from the group consisting of hydrogen chloride, and chlorinated hydrocarbons which liberate hydrogen chloride under said contacting conditions, said minor amount, based by weight upon said feed and calculated as hydrogen chloride, being in the range of from about 10 to 500 ppmw; said composite, based by weight upon alumina and calculated as the element, containing an amount of chloride in the range of from about 1 to 3.0 weight percent, and an amount each of platinum and rhenium in the range of from about 0.1 to 1 weight percent;

(II) separating the mixture resulting from step (1) in a liquid-gas separation zone into (1) a gaseous fraction comprising mainly hydrogen gas, hydrogen chloride and a minor amount of normally gaseous hydrocarbons, and (2) a first liquid hydrocarbon fraction;

(III) withdrawing said gaseous fraction from said separation zone and passing at least a portion thereof in recycle to said reaction zone;

(IV) fractionally distilling said separated first liquid fraction into a second liquid fraction and a normally gaseous hydrocarbon fraction, said second liquid fraction, relative to said feed, having an improved octane number.

6. A process as in claim 5 wherein (1) said temperature is in the range of from about 365° to 390° C., and (2) said recycle stream hydrogen chloride content is in the range of from about 20 to 150 ppmv.

7. A process as in claim 5 wherein said recycle stream hydrogen chloride content is about 60 ppmv.

8. A process as in claim 5 wherein said hydrogen partial pressure is a generated hydrogen partial pressure.

9. A process as in claim 5 wherein said fresh chloride source is a butyl chlorde.

10. A process as in claim 5 wherein there is no net make or consumption of hydrogen gas.

* * * * *